US008826795B2

(12) United States Patent
Capouellez

(10) Patent No.: US 8,826,795 B2
(45) Date of Patent: Sep. 9, 2014

(54) BLAST HOP MITIGATION DEVICE

(75) Inventor: James A. Capouellez, Lake Orion, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 132 days.

(21) Appl. No.: 13/483,534

(22) Filed: May 30, 2012

(65) Prior Publication Data

US 2014/0013933 A1 Jan. 16, 2014

(51) Int. Cl.
*F41H 7/02* (2006.01)
*F41H 7/04* (2006.01)

(52) U.S. Cl.
CPC ..... *F41H 7/044* (2013.01)
USPC ..... 89/36.08; 89/36.04; 89/36.01; 89/918; 89/929; 89/930; 296/187.08; 296/187.07

(58) Field of Classification Search
CPC ..... F41H 5/14; F41H 7/00; F41H 7/04; F41H 7/042; F41H 7/044; F41H 7/048
USPC ..... 89/36.01, 36.02, 36.07, 36.08, 36.09; 296/187.07, 187.08
See application file for complete search history.

(56) References Cited

U.S. PATENT DOCUMENTS

| | | | | |
|---|---|---|---|---|
| 4,326,468 | A * | 4/1982 | King et al. | 109/49.5 |
| 6,154,922 | A | 12/2000 | Vanderlinden | |
| 6,813,986 | B1 * | 11/2004 | Tafoya et al. | 86/50 |
| 7,437,987 | B1 | 10/2008 | Ohnstad et al. | |
| 8,087,337 | B1 | 1/2012 | Cary | |
| 8,459,167 | B1 * | 6/2013 | Gonzalez | 89/36.02 |
| 8,584,572 | B2 * | 11/2013 | Tunis et al. | 89/36.09 |
| 8,640,592 | B1 * | 2/2014 | Gabrys et al. | 89/36.04 |
| 2007/0113730 | A1 * | 5/2007 | Benyami et al. | 89/36.02 |
| 2007/0186762 | A1 * | 8/2007 | Dehart et al. | 89/36.09 |
| 2010/0206158 | A1 * | 8/2010 | Neethling | 89/36.02 |
| 2011/0148147 | A1 * | 6/2011 | Tunis et al. | 296/187.07 |
| 2012/0043152 | A1 * | 2/2012 | Jacob-Lloyd | 180/292 |
| 2012/0097020 | A1 * | 4/2012 | Hazan | 89/36.08 |
| 2012/0192706 | A1 * | 8/2012 | Gonzalez | 89/36.02 |
| 2012/0193940 | A1 * | 8/2012 | Tunis et al. | 296/187.07 |
| 2012/0204711 | A1 * | 8/2012 | Engleman et al. | 89/36.02 |
| 2012/0312607 | A1 * | 12/2012 | Joynt et al. | 180/54.1 |

OTHER PUBLICATIONS

Spoiler (automotive), Internet, Wikipedia, p. 1-5.
Jet blast deflector, Internet, Wikipedia, p. 1-4.

* cited by examiner

*Primary Examiner* — Bret Hayes
*Assistant Examiner* — Derrick Morgan
(74) *Attorney, Agent, or Firm* — David L. Kuhn; Thomas W. Saur; Luis Miguel Acosta

(57) ABSTRACT

A structure for protecting vehicle occupants from blasts beneath a vehicle, the structure having a mechanism for mitigating vehicle hop caused by the blasts. The structure comprises a rigid V shaped hull section of the vehicle located on an underside thereof. The V shaped hull section has an oblique body panel facing outboard and downward relative to the vehicle. The structure also has a wall panel disposed adjacently above and along the oblique body panel and a border defined by a juncture of the oblique body panel and the wall panel. A flat, blade-like blast deflector vane is located proximally along the border and is positioned outboard of both the oblique body panel and the wall panel. The vane is disposed at an acute angle with the oblique body panel and is solidly attached to the V shaped hull section.

13 Claims, 3 Drawing Sheets

BLAST HOP MITIGATION DEVICE

GOVERNMENT INTEREST

The invention described here may be made, used and licensed by and for the U.S. Government for governmental purposes without paying royalty to me.

BACKGROUND OF THE INVENTION

1. Field of the Invention

The present invention generally relates to methods and structures for protecting the occupants of a military vehicle. More particularly the invention relates to structures for mitigating the effect on vehicle occupants of an upward force on a vehicle created by an explosive blast underneath the vehicle. The device is intended for use on vehicles travelling in combat areas where land mines, improvised explosive devices (IEDs) or like munitions explode as a vehicle passes over them. The invention is also related to military vehicle "V hulls" whose underside has a V shape or a truncated V shape; the present invention is particularly suitable for such vehicles. V hulls deflect blast forces occurring under a vehicle to a generally outboard direction from the vehicle. The invention uses a vane that cooperates with the V hull to provide an additional deflection of blast force, so that the blast force ultimately exerts a downward force component on a vehicle. The invention thus mitigates the vertical rise or "hop" of the vehicle when a mine explodes beneath it. The mitigating effect of the invention reduces spinal injuries or other injuries to occupants of the vehicle.

2. Background Art

A relevant technology has to do with blast fences or jet blast deflectors commonly used at airports. These devices are wall-like structures positioned behind jet aircraft so that jet exhaust is directed upward and away from nearby personnel, equipment or buildings. Jet blast deflectors are described in numerous places, an example being http://en.wikipedia.arg/wiki/Jet_blast_deflector. A jet blast deflector is also shown by U.S. Pat. No. 7,437,987 B1 to Ohnstad et al. Another relevant technology is gun muzzle design wherein the muzzle has vents on the upper side. When the gun fires, part of the effluent from the gun blast is directed upward by the vents so as to create a downward force counteracting rise of the gun barrel. An example of the aforementioned gun muzzle technology is U.S. Pat. No. 8,087,337 to Cary. The web site http://www-.brownells.com/.aspx/pid=27642/Product/S-W-M-P-PRE-FIT-MATCH-GRADE-BARRELS shows anti rise gun muzzles as well.

Still another relevant technology has to do with spoilers, air dams or wings fitted to automobiles. Air dams are used on the front of vehicles to reduce air flow under the vehicle as it travels, thereby reducing drag. Spoilers on the aft ends of vehicles typically increase air pressure at the zone behind the rear window over the trunk to create down force at that zone. Other so-called spoilers are actually wings that create down force on vehicles in the way aircraft wings create lift. A general discussion of vehicle air dams, spoilers and wings is at http://en.wikipedia.org/wiki/Spoiler (automotive). Relevant art is also shown by a floor sweeper vehicle having a flap to upwardly deflect a stream of air and debris into a hopper, as shown in U.S. Pat. No. 6,154,922 to Vanderlinden.

Of possible relevance is U.S. Patent Application Publication 2011/014817 A1 to Tunis et al. The main thrust of Tunis is a structural through-channel open at the top and bottom of a vehicle body to allow blast force under the vehicle to escape to a zone above the vehicle. Such a channel is shown in FIGS. 1 and 2 of Tunis. Additionally, at FIGS. 25 through 28 of Tunis are notional diagrams of blast force vectors, as at 974. These vectors are affected by a V hull of proposed vehicle 970 and proposed hull structural channels. FIGS. 26 and 27 show a vehicle hull incorporating elbow-shaped structural channels 980. Tunis asserts that force vectors 974 directed along a V hull surface into channels 980 cause a net downward force on vehicle 970. But vector 974 in FIG. 26 is parallel to the lower half of channel 980; this vector would impact the outboard wall in the upper half of the channel 980. The impact is in an upward direction, so the kinetic energy of effluent travelling along vector 974 imparts an upward force component on channel 980. Also, a detonation at a location on the ground will have force vectors radiating from the location. Some of the radiating vectors will impact the underside (or outboard side) of the lower half of channel 980. The impact will cause an upward force component on vehicle 970. Tunis does not reveal how the foregoing impacts are overcome so as to result in a net downward force component caused by structural channels 970; in fact, it appears that the aforementioned impacts cause a net upward force on vehicle 970.

SUMMARY OF THE INVENTION

The invention is structure for reducing injury to vehicle occupants caused by explosions beneath a vehicle. The structure mitigates the vehicle's upward acceleration or hop caused by the explosions. The invention is essentially a blade-like vane cooperating with a vehicle hull to direct explosion forces upward, thereby creating a downward force on the vehicle that reduces vehicle hop. The invention includes a rigid armored V shaped hull section on the vehicle's underside, this section having an oblique underbody panel facing outboard and downward relative to the vehicle. There is a wall panel of the vehicle disposed adjacently above and along the oblique body panel. The juncture between the oblique underbody panel and the wall panel defines a border along which the vane is disposed, and the vane is located completely outboard of both the oblique body panel and the wall panel. The vane is oriented at a first acute angle with the oblique underbody panel and is also oriented at a second acute angle with respect to a vertical plane. Brackets or other suitable means are used for attaching the blast deflector vane to the V shaped hull section. In an alternative embodiment one or more blast deflector vanes are incorporated in a running board disposed along the border.

DETAILED DESCRIPTION OF THE PREFERRED EMBODIMENT(S)

Figure 1:
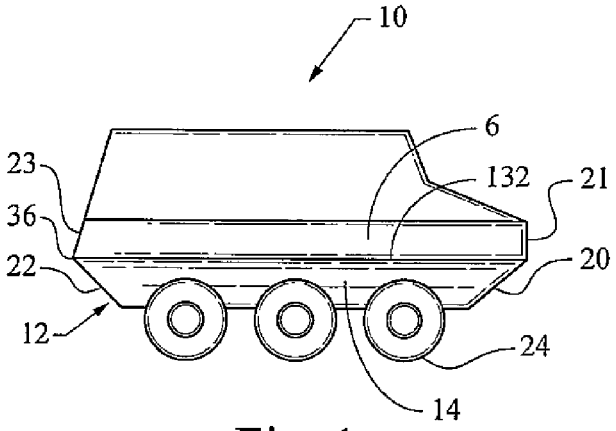
FIG. 1 is a side view of a notional wheeled military vehicle.

Definitions and Terminology:

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, dimension, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

For a vehicle, and a system mounted on or used in connection with the vehicle, forward/reverse (longitudinal) and vertical (up/down) directions are generally relative to the vehicle and system as typically operated (e.g., when the vehicle is operated with the respective powertrain in a forward/reverse mode). As such, lateral (left/right) directions are generally perpendicular to the longitudinal/vertical plane, and are referenced from a vehicle operator (e.g., driver) perspective. A first direction (e.g., forward) and a second direction (e.g., rearward or reverse) where the second direction substantially, but not necessarily wholly, opposes the first direction are also generally or used in connection with the vehicle. Likewise, elements located (mounted, positioned, placed, installed, etc.) on, near, or proximate to the vehicle body are generally referred to as "inner", while elements that are distal or more remote to the vehicle body are generally referred to as "outer", unless otherwise noted. As such, inner elements are generally closer to the vehicle body than outer elements. Unless otherwise stated, a vehicle is presumed to be standing on a horizontal surface and vehicle components, such as a body panel or window that are vertically oriented, are disposed normal to the horizontal surface. Likewise, "the vertical" or a "vertical plane" refers to a plane normal to the horizontal surface upon which the vehicle rests.

Figure 2:
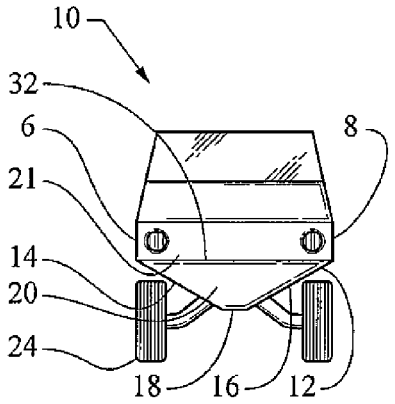
FIG. 2 is a front view of the notional military vehicle

FIGS. 1 and 2 show a notional wheeled military vehicle 10 having a V hull 12, the forward end of the vehicle being on the right in FIG. 1. FIG. 2 is a front view of the notional vehicle. V hull 12 has two oblique underbody panels 14 and 16 which face outboard and down from the vehicle and a mid underbody panel 18 integral with the oblique underbody panels and connecting them. Panels 14 and 16 are joined to vertically oriented hull side wall panels or sections 6 and 8. The aforesaid underbody panels form a shallow, generally V-shaped configuration or V-shaped section on the underside of the vehicle as the vehicle is viewed from the forward or rearward direction. V hull 12 has an obliquely oriented forward hull panel 20 and an obliquely oriented rearward hull panel 22 both of which face outboard and downward from vehicle 10. Hull panel 20 is joined to vertically oriented front wall panel or hull section 21; and hull panel 22 joins to rear wall panel or hull section 23, which is slanted relative to the vertical but which may be vertically oriented as well. Oblique body panels 14, 16, 20 and 22 are typically disposed at an angle $\theta$ between 10 degrees and 45 degrees with a reference plane 100 parallel to the ground surface on which vehicle 10 rests, as perhaps best illustrated in FIG. 3. Hull sections 21 and 23 are oriented at angle $\delta$ between 80 degrees and 120 degrees with respect to plane 100, again as perhaps best shown in FIG. 3. Some designers of military vehicles would consider vehicle 10 to be a "double V" hull vehicle wherein panels 20 and 22 form with panel 18 a second V-shaped section intersecting with the first V-shaped section described above. Another form of double V hull is consists of two parallel V shaped hull sections on the underside of a vehicle, much like the twin hull configuration of a catamaran watercraft. Unless otherwise specified, "double V hull" will include both of the aforementioned V hull types. All of the aforementioned panels and hull 12 generally are of armored construction and can be fabricated from known armor materials arranged in conventional ways. The wheels of vehicle 10 are shown at 24.

Figure 3:
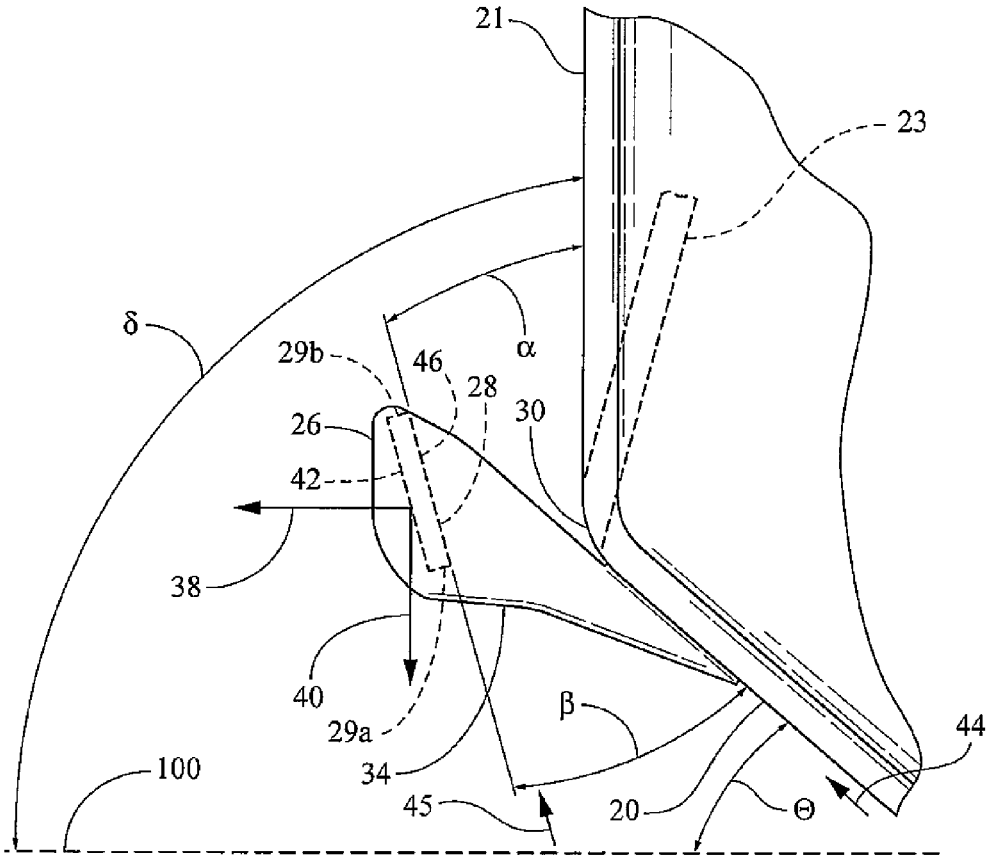
FIG. 3 is a detail view of a blast deflector as installed on the notional vehicle.
Figure 4:
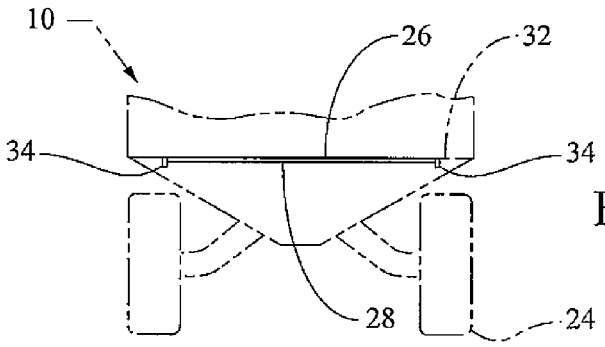
FIG. 4 shows a blast deflector installed on the front of the vehicle, the vehicle being represented by phantom lines.

FIG. 3 is a detail view of a blast deflector 26 that is attached to the front of vehicle 10 at the juncture between front hull section 21 and hull panel 20. FIG. 4 shows deflector 26 on vehicle 10 as seen from a position in front of the vehicle. Deflector 26 includes a blast deflector vane 28 solidly connected to panel 20 by means of a bracket 34 wherein the vane's upper edge **29*b* is further outboard than the vane's lower edge 29*a*. Vane 28 is an elongate, flat, blade-like component which can be constructed of steel and is disposed at an acute angle $\beta$ preferably between 1 degree and 20 degrees with one of the oblique panels such as oblique panel 20 in FIG. 3. Vane 28 will also typically form an angle $\alpha$ between 1 degree and 20 degrees with a plane vertical to reference plane 100 and parallel to the lateral (side-to-side) axis of vehicle 10, as best envisioned in by reference to FIG. 3. In an alternate manner of speaking, vane 28 is disposed at the angle $\alpha$ with front hull section 21**, which is vertically oriented.

Vane 28 is preferably disposed along but completely outboard of hull section 21 and hull panel 20. Vane 28 is typically two to three inches wide and the bottom or lower edge **29*a* of vane 28 is typically disposed two to three inches outboard from front hull section 21. It is preferred that lower edge 29*a* be lower (closer to plane 100) than the inter panel border or nexus 30 between forward hull panel 20 and forward hull section 21, preferably by a distance of one-half an inch to an inch. It is also preferred that upper edge 29*b* be higher (further from plane 100) than the border 30. The border can be rounded as shown at 30 or can form an edge line as shown at 32 in FIG. 1. Vane 28 is typically at least three feet in length but can be longer; optionally vane 28 can extend across the width of V hull 12**.

Another blast deflector 26 can be placed on the rearward end of vehicle 10 along border 36 (FIG. 1) between rearward hull panel 22 and rear hull section 23. The angular orientation and disposition of the additional deflector is the same as shown in FIG. 3 except that rear hull section 23 (shown in phantom for illustrative purposes in FIG. 3) is canted inboard and is thus not vertically oriented, as is front hull section 21. For most applications, it is preferred that pairs of deflectors 26 are symmetrically formed and located. Thus it is normally preferred that the deflectors at the rearward and forward ends of the vehicle are mirror images of one another, are both centered with respect to a vertical plane along the vehicle's longitudinal axis, and are equidistant from plane 100.

Figure 5:
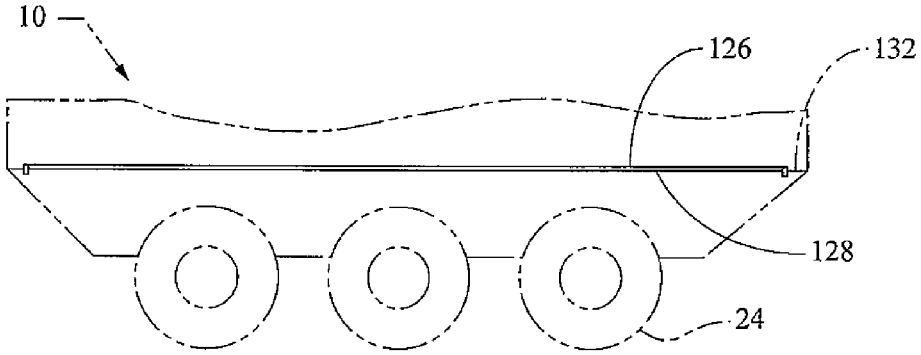
FIG. 5 shows another blast deflector, which is installed on the side of the vehicle, the vehicle again shown by phantom lines.

It is also contemplated that a blast deflector similar to that shown in FIGS. 3 and 4 can be mounted to the sides of vehicle 10 as shown at 126 in FIG. 5. Aside from its length, vane 128 is shaped, oriented and disposed in the same fashion as is vane 28, and can optionally extend as far as the entire length of hull 12. Vane 128 will be disposed at the same angle $\alpha$ relative to hull section 6 or hull section 8 or other vertically oriented component as vane 28 is disposed relative to forward hull section 21. Vane 128 can also be said to form the acute angle $\alpha$ with a vertical plane parallel to the longitudinal (front to back) axis of vehicle 10. Vane 128 will extend slightly below side inter panel border 132 (FIG. 1) in the same way vane 28 extends slightly below front inter panel border 32.

Vanes 128 can, but need not, extend the full length of the vehicle. It is normally preferred that the deflectors on the sides of the vehicle are symmetric such that they are mirror images of one another, are both centered with respect to a vertical plane along the vehicle's transverse axis, and are equidistant from plane 100. It is also preferred that vanes 28 and 128 will have similar widths and thicknesses, and are sufficiently rigid and strong to prevent deformation or damage by detonations under vehicle 10. When a land mine, improvised explosive device (IED) or other blast mechanism detonates underneath a military vehicle, the detonation typically does not occur under the center of the vehicle. The detonation is commonly forward or aft of the vehicle center and is commonly either to the right or left of the vehicle's center. Consequently, depending on the location of the detonation, any downwardly or partly downwardly facing surface on or at the underside of vehicle can be impacted by the detonation and contribute to upward acceleration of the vehicle. Therefore it is considered advantageous that vanes of blast deflector 26 or 126 are disposed completely outboard of vehicle hull 12. As seen in FIG. 3, vane 28 of deflector 26 has an outboard face 42 which is tilted downwardly. Depending on the location of a detonation underneath a vehicle, locating deflector 26 underneath the hull and not outboard of the hull would cause vane 28 to contribute to, or at least not mitigate, upward acceleration of vehicle 10. Note that mine blasts or the like occurring outboard of the vehicle are less likely to cause vehicle hop, or will cause less vehicle hop, than blasts under and inboard of the vehicle, and this fact is considered in the design of the invention herein. While outboard blasts are not to be ignored, they present less of a problem in terms of vehicle hop than inboard blasts.

When a mine blast or the like impacts the underside of V hull 12, the hull directs blast force outboard. For example, as seen in FIG. 3, forward hull panel 20 directs blast force originating beneath the vehicle in the direction of vector 44, along oblique panel 20, so that the blast force impacts strike face 46 of vane 28. The impact force on vane 28 can be resolved into component force vectors 38 and 40 where vector 38 has a horizontal outboard direction and vector 40 has a vertical downward direction. The force along vector 40 mitigates the upward acceleration or "hop" of vehicle 10 which is caused by a detonation under a vehicle.

It will also be understood that explosions from land mines or IEDs can vary in nature. For example, some mines or IEDs are constructed or buried so that the blast force from detonation is mainly straight upward. Other mines or IEDs have blast forces that propagate from a center to form a generally hemispherical wave front at the blast periphery. As a function of the mine's or IED's nature and the under-vehicle location of a detonation, there can be a variable blast force vector impacting vane 28 or 128 that is different from vector 44. Such an additional blast force vector is exemplified by vector 45 in FIG. 3. Vane 28 or 128 is preferably oriented so that additional force vectors, as at 45, will either impact strike face 46 to create additional downward thrust or else have no vertical thrust effect. Accordingly, vane 28 or 128 is oriented essentially edgewise relative to additional force vectors such as vector 45, as seen in FIG. 3. It will be understood that blast deflectors 26 and 126 are designed for V hulled vehicles with attention to the blast resistance, strength and rigidity of the vehicles' lower hull components. Inhibition of vehicle hop by deflectors 26 and 126 during detonations increases the effective impact force experienced by underbody components of the vehicles. Thus, one may consider the need for additional rigidity and strength in underbody panels such as panel 14, 16 and 18 on vehicle 10; likewise one may consider the rigidity and strength of forward hull panel 20 and rearward hull panel 22. It is believed that many V hulled military vehicles, such as the U.S. Army's Mine Resistant Ambush Protective (MRAP) vehicle presently possess the hull strength, rigidity and hardness to accommodate addition of deflectors 26 or 126. For other V hulled vehicles it is believed that conventional approaches to reinforcing underbody armor can be used to modify them, if necessary, to accommodate blast deflectors 26 and 126.

Figure 6:
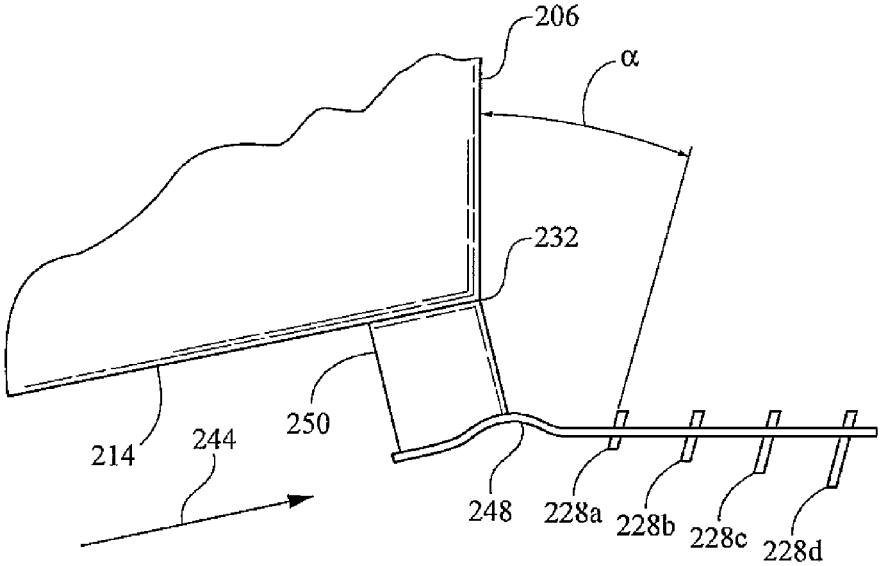
FIG. 6 is a detail view of an alternate embodiment of the blast deflector.
Figure 7:
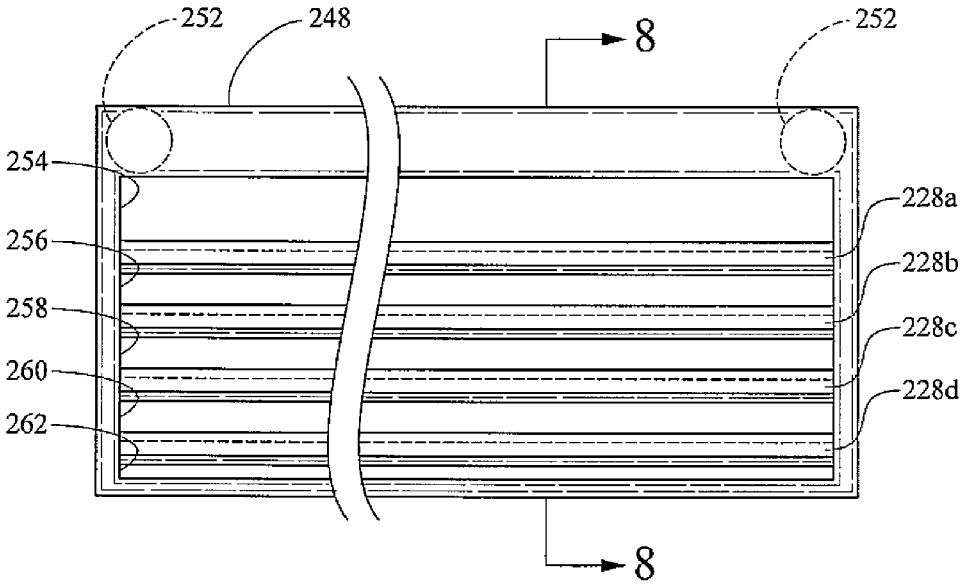
FIG. 7 is a plan view of a running board which is a component of the alternate embodiment.
Figure 8:
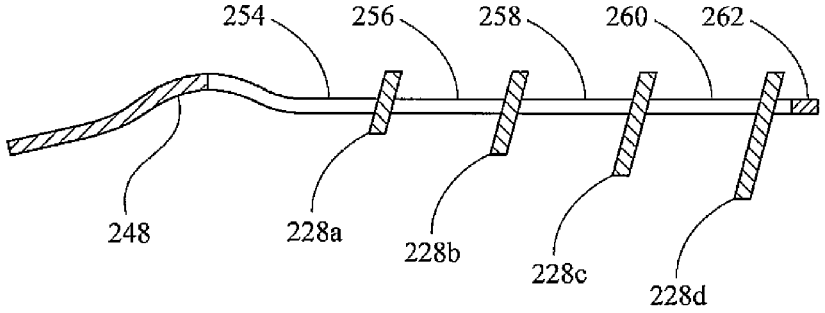
FIG. 8 is a sectional view taken along lines 8-8 in FIG. 7.

FIG. 6 shows an alternate embodiment of the invention wherein a set of vanes 228*a-d* are incorporated into a slotted running board 248 fixed by post 250 to oblique underbody panel 214, which is analogous to panel 14 discussed above, of a V hulled vehicle. Running board 248 is disposed along inter panel border 232, analogous to side inter panel border 132 discussed above, and running board 248 is preferably disposed a short distance (typically one to three inches) below border 232. Vanes 228*a-d* extend increasingly further downward in a progression from inboard most vane 228*a* to outboard most vane 228*d*, although the tops of vanes 228*a-d* are equidistant from running board 248. Vanes 228*a-d* are disposed at the same angle $\alpha$ as discussed above with respect to a vertical plane or to hull side section 206, which is vertically oriented. A top view of running board 248 is shown in FIG. 7 where zones 252 indicate where posts 250 attach to running board 248. As best seen in that Figure, running board 248 defines elongate slots 254, 256, 258 260 and 262.

When a blast force travels along panel 214 in the direction of vector 244, the blast force will impact vanes 228*a-d* so as to create a downward force component which inhibits hop of the vehicle on which running board 248 is installed. Running board 248 also serves as a conventional vehicle running board by providing a step for soldiers entering a vehicle or providing a platform upon which a soldier may stand when servicing or loading the vehicle.

Various alterations and modifications will become apparent to those skilled in the art without departing from the scope and spirit of this invention and it is understood this invention is limited only by the following claims.

What is claimed is:

1. A structure for protecting vehicle occupants from a blast beneath a vehicle, the structure mitigating vehicle hop caused by the blast wherever the blast occurs under the vehicle, the structure comprising:

a vehicle hull;

a V shaped hull section of the vehicle hull, the V shaped hull section located on an underside of the vehicle, the V shaped hull section having an oblique body panel facing outboard and downward relative to the vehicle;

a wall panel of the vehicle disposed adjacently above and along the oblique body panel;

a border defined by a juncture of the oblique body panel and the wall panel;

means for creating a downward force on the vehicle in response to the blast, the creating means being a blast redirection structure consisting of a flat, blade-like blast deflector vane located along the border and located entirely outboard of the oblique body panel and the wall panel, the blast deflector vane disposed at an acute angle $\beta$with the oblique body panel; and the blast deflector vane attached to the V shaped hull section.

2. The structure of claim 1, wherein the blast deflector vane is disposed at an acute angle a relative to a vertical plane.

3. The structure of claim 1, wherein a lower edge of the blast deflector vane is disposed lower relative to the vehicle than the border.

4. The structure of claim 1, wherein, during the blast under the vehicle, the blast deflector vane is impacted by one force vector along the oblique body panel and is impacted by an additional force vector from a source of the blast, and wherein the vane is oriented essentially edgewise to the additional force vector such that the entire blast deflection vane is oriented essentially parallel to the additional force vector.

5. The structure of claim 3, wherein an upper edge of the blast deflector vane is disposed higher relative to the vehicle than the border.

6. The structure of claim 2, wherein the blast deflector vane is a first elongate deflector vane oriented laterally with respect to the vehicle and the vehicle structure includes a second elongate deflector vane oriented longitudinally relative to the vehicle.

7. The structure of claim 6, wherein the first deflector vane extends for the width of the vehicle hull and the second deflector vane extends for the length of the vehicle hull.

8. A vehicle structure for protecting vehicle occupants from blast forces generated by a detonation under the vehicle, the structure mitigating vehicle hop caused by the detonation wherever the detonation occurs under the vehicle, the structure comprising:

a vehicle hull;

a first V shaped hull section of the vehicle hull, the first V shaped hull section located on an underside of the vehicle, the first V shaped hull section having a first oblique body panel facing outboard and downward relative to the vehicle;

a first wall panel of the vehicle disposed adjacently above and along the first oblique body panel;

a first border defined by a juncture of the first oblique body panel and the first wall panel;

a first means for creating a downward force on the vehicle in response to the detonation, the first creating means being a first blast redirecting structure consisting of a first flat, blade-like blast deflector vane located along the first border and located entirely outboard of the first oblique body panel and the first wall panel, the first blast deflector vane disposed at a first acute angle with the first oblique body panel;

a bottom edge of the first blast deflector vane disposed lower relative to the vehicle than the first border;

the first blast deflector vane attached to the first V shaped hull section;

wherein, during a blast under the vehicle, the first blast deflector vane is impacted by a first force vector along the first oblique body panel and is impacted by a second force vector from a source of the blast, and wherein the first blast deflector vane is oriented essentially edgewise to the second force vector such that the entire first blast deflector vane is oriented essentially parallel to the second force vector;

a second V shaped hull section of the vehicle hull intersecting the first V shaped hull section, the second V shaped hull section having a second oblique body panel facing outboard and downward relative to the vehicle;

a second wall panel of the vehicle disposed adjacently above and along the second oblique body panel;

a second border defined by a juncture of the second oblique body panel and the second wall panel;

a second means for creating a downward force on the vehicle in response to the detonation, the second creating means being a second blast redirection structure consisting of a second flat, blade-like blast deflector vane located along the second border and located entirely outboard of the second oblique body panel and the second wall panel, the second blast deflector vane disposed at a second acute angle with the second body panel;

a bottom edge of the second blast deflector vane disposed lower relative to the vehicle than the second border; and the second blast deflector vane attached to the second V shaped hull section;

wherein, during the blast under the vehicle, the second blast deflector vane is impacted by a third force vector along the second oblique body panel and is impacted by a fourth force vector from the source of the blast, and wherein the second blast deflector vane is oriented essentially edgewise to the fourth force vector such that the entire second blast deflection vane is oriented essentially parallel to the fourth force vector.

9. The vehicle structure of claim 8 wherein the first deflector vane is oriented laterally with respect to the vehicle and the second deflector vane is oriented longitudinally relative to the vehicle.

10. The vehicle structure of claim 9 further comprising;

a pair of first deflector vanes symmetrically formed and oriented relative to the vehicle;

and a pair of second deflector vanes symmetrically formed and oriented relative to the vehicle.

11. The vehicle structure of claim 9, wherein the first deflector vane extends for the width of the vehicle hull and the second deflector vane extends for the length of the vehicle hull.

12. The structure of claim 1 wherein the acute angle $\beta$is between 1 and 20 degrees.

13. The structure of claim 12 wherein the blast deflector vane disposed at an acute angle $\alpha$with the wall panel, and wherein the acute angle $\alpha$is between 1 and 20 degrees.

* * * * *